US008262395B2

(12) United States Patent
Ke et al.

(10) Patent No.: US 8,262,395 B2
(45) Date of Patent: Sep. 11, 2012

(54) POWER CONNECTOR ASSEMBLY WITH IMPROVED TERMINALS

(75) Inventors: Yu-Feng Ke, Taoyuan County (TW); Sheng-Hsiang Huang, Taipei County (TW); Hsien-Ning Chin, Taoyuan County (TW)

(73) Assignee: Chief Land Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 12/978,720

(22) Filed: Dec. 27, 2010

(65) Prior Publication Data

US 2012/0164892 A1 Jun. 28, 2012

(51) Int. Cl.
*H01R 12/00* (2006.01)

(52) U.S. Cl. ..... 439/79

(58) Field of Classification Search ..... 439/79
See application file for complete search history.

(56) References Cited

U.S. PATENT DOCUMENTS 5,158,471 A * 10/1992 Fedder et al. ..... 439/80
5,630,720 A * 5/1997 Kocher ..... 439/78
5,667,392 A * 9/1997 Kocher et al. ..... 439/79
6,299,492 B1 * 10/2001 Pierini et al. ..... 439/884
6,319,075 B1 * 11/2001 Clark et al. ..... 439/825
6,394,818 B1 * 5/2002 Smalley, Jr. ..... 439/79
6,402,566 B1 * 6/2002 Middlehurst et al. ..... 439/699.1
6,773,314 B2 * 8/2004 Mills et al. ..... 439/850
6,776,635 B2 * 8/2004 Blanchfield et al. ..... 439/181
6,780,027 B2 * 8/2004 Allison ..... 439/79
6,814,590 B2 * 11/2004 Minich et al. ..... 439/79
6,835,103 B2 * 12/2004 Middlehurst et al. ..... 439/699.1
6,848,950 B2 * 2/2005 Allison et al. ..... 439/682
6,848,953 B2 * 2/2005 Schell et al. ..... 439/825
6,869,294 B2 * 3/2005 Clark et al. ..... 439/79
6,890,221 B2 * 5/2005 Wagner ..... 439/855
6,955,570 B2 * 10/2005 Mills et al. ..... 439/850
7,001,189 B1 * 2/2006 McGowan et al. ..... 439/79
7,059,919 B2 * 6/2006 Clark et al. ..... 439/825
7,070,464 B2 * 7/2006 Clark et al. ..... 439/825
7,083,433 B2 * 8/2006 Misawa et al. ..... 439/80
7,220,141 B2 * 5/2007 Daily et al. ..... 439/290
7,258,562 B2 * 8/2007 Daily et al. ..... 439/290
7,314,377 B2 * 1/2008 Northey et al. ..... 439/79
7,335,043 B2 * 2/2008 Ngo et al. ..... 439/290
7,374,436 B2 * 5/2008 Schell et al. ..... 439/79
7,402,064 B2 * 7/2008 Daily et al. ..... 439/290
7,425,145 B2 * 9/2008 Ngo ..... 439/290
7,458,839 B2 * 12/2008 Ngo et al. ..... 439/291
7,476,108 B2 * 1/2009 Swain et al. ..... 439/79
7,488,217 B2 * 2/2009 Cheng et al. ..... 439/668
7,604,489 B2 * 10/2009 Shuey et al. ..... 439/79
7,641,523 B2 * 1/2010 Chen ..... 439/825
7,690,937 B2 * 4/2010 Daily et al. ..... 439/290

(Continued)

*Primary Examiner* — Ross Gushi
(74) *Attorney, Agent, or Firm* — Rosenberg, Klein & Lee

(57) ABSTRACT

A power connector assembly with improved terminals includes a first electrical connector and a second electrical connector. The first electrical connector has a first insulated body and a plurality of first power-terminal sets received in the first insulated body. The second electrical connector has a second insulated body and a plurality of second power-terminal sets received in the second insulated body. Each of the first power-terminal sets is contacted with each of the second power-terminal sets correspondingly. Each second power-terminal set has a pair of separate second power terminals. Each second power terminal has a contacting portion for contacting with the first power-terminal set. Each contacting portion is protruded with at least one bulge portion toward the first power-terminal set from a side thereof.

11 Claims, 6 Drawing Sheets

U.S. PATENT DOCUMENTS

| | | | | |
|---|---|---|---|---|
| 7,726,982 | B2 * | 6/2010 | Ngo | 439/79 |
| 7,762,857 | B2 * | 7/2010 | Ngo et al. | 439/856 |
| 7,775,822 | B2 * | 8/2010 | Ngo et al. | 439/290 |
| 7,806,738 | B2 * | 10/2010 | Wu et al. | 439/860 |
| 7,862,359 | B2 * | 1/2011 | Daily et al. | 439/290 |
| 7,905,731 | B2 * | 3/2011 | Ngo et al. | 439/75 |
| 7,976,317 | B2 * | 7/2011 | Patel et al. | 439/79 |
| 8,062,046 | B2 * | 11/2011 | Daily et al. | 439/290 |
| 8,096,814 | B2 * | 1/2012 | Schell et al. | 439/79 |
| 2002/0034889 | A1 * | 3/2002 | Clark et al. | 439/79 |
| 2002/0193019 | A1 * | 12/2002 | Blanchfield et al. | 439/857 |
| 2003/0181106 | A1 * | 9/2003 | Schell et al. | 439/825 |
| 2003/0219999 | A1 * | 11/2003 | Minich et al. | 439/79 |
| 2004/0147177 | A1 * | 7/2004 | Wagner | 439/855 |
| 2005/0042901 | A1 * | 2/2005 | Minich et al. | 439/79 |
| 2005/0118846 | A1 * | 6/2005 | Clark et al. | 439/108 |
| 2006/0003620 | A1 * | 1/2006 | Daily et al. | 439/295 |
| 2006/0128197 | A1 * | 6/2006 | McGowan et al. | 439/212 |
| 2006/0194481 | A1 * | 8/2006 | Clark et al. | 439/825 |
| 2006/0228927 | A1 * | 10/2006 | Daily et al. | 439/290 |
| 2006/0228948 | A1 * | 10/2006 | Swain et al. | 439/660 |
| 2006/0281354 | A1 * | 12/2006 | Ngo et al. | 439/290 |
| 2007/0197063 | A1 * | 8/2007 | Ngo et al. | 439/108 |
| 2007/0202748 | A1 * | 8/2007 | Daily et al. | 439/608 |
| 2007/0275586 | A1 * | 11/2007 | Ngo | 439/290 |
| 2007/0293084 | A1 * | 12/2007 | Ngo | 439/552 |
| 2008/0214027 | A1 * | 9/2008 | Schell et al. | 439/79 |
| 2008/0248670 | A1 * | 10/2008 | Daily et al. | 439/290 |
| 2009/0042417 | A1 * | 2/2009 | Ngo et al. | 439/79 |

* cited by examiner

POWER CONNECTOR ASSEMBLY WITH IMPROVED TERMINALS

BACKGROUND OF THE INVENTION

1. Field of the Invention

The present disclosure is related to a power connector assembly with improved terminals, especially to a connector assembly including a plug connector and a socket connector for power transmission between the circuit boards.

2. Description of Related Art

To design a plug connector and a socket connector for transmitting power between the circuit boards should consider not only the electrical signal, but also the electrical power. Although the part of electrical signal is equipped with low current, the part of electrical power with comparative higher current may influence the electrical characteristic potentially.

The part of electrical power includes a plurality of male power terminals and female power terminals connected to each other. The connection of each set of power terminals must not only be good and secure, but further striving for high performance current transmission, thus machines, such as a computer server, could operate safely and reliably.

Besides, the impact of the plug connector against the socket connector during the connection should also be considered when designing power terminals. The conventional power terminals are soldered on a circuit board and the top edge of the power terminal is fixed in the insulated body of the connector. With such configuration, a twisting torque resulted from the impact during the connection may happen to the terminals, and the terminals may be loosened, then the connection stability may be affected. Even, the power terminals may be damaged.

Therefore, it is necessary to propose a novel electrical connector to overcome the above-mentioned problems.

SUMMARY OF THE INVENTION

The present disclosure provides a power connector assembly with improved terminals, which at least provides well-connected power terminals and high performance current transmission.

In order to achieve the above objectives, the present disclosure is to provide a power connector assembly with improved terminals, which includes a first electrical connector and a second electrical connector. The first electrical connector includes a first insulated body and a plurality of first power-terminal sets. The first insulated body is formed with a plurality of first terminal receiving grooves for respectively receiving the plurality of first power-terminal sets. The second electrical connector includes a second insulated body, and a plurality of second power-terminal sets. The second insulated body is formed with a plurality of second terminal receiving grooves for receiving the plurality of second power-terminal sets. Each first power-terminal set correspondingly contacts the second power-terminal set. Each second power-terminal set has a pair of separate second power terminals. Each second power terminal has a contacting portion for electrically contacting the first power-terminal set. Each contacting portion is protruded with at least one bulge portion toward the first power-terminal set from a side thereof.

Therefore, the present disclosure has advantages as followed. The bulge portion can increase the contacting stress between the first power-terminal sets and the second power-terminal sets, such that the contact resistance can be reduced and a stable contact can be provided, thereby providing excellent electrical contact.

Further, the present disclosure can enhance the mounting stability of power terminals. The first power-terminal set has a pair of separate first power terminals. Each of the first and second power terminals includes a fixing portion and a plurality of soldering legs downward extended from the fixing portion, wherein the contacting portion is forward extended from the fixing portion. Each fixing portion has four corners respectively wedged in the first and second terminal receiving groove. Therefore, the fixing portions of the power terminals are well fixed in the terminal receiving grooves, which would prevent the power terminals from drawing back and avoid to be loosened.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE PREFERRED EMBODIMENTS

In order to better understand the objective, structure, characteristics, and effects of the present disclosure, a description relating thereto will be made with reference to preferred embodiments thereof and the accompanying drawings.

Figure 1:
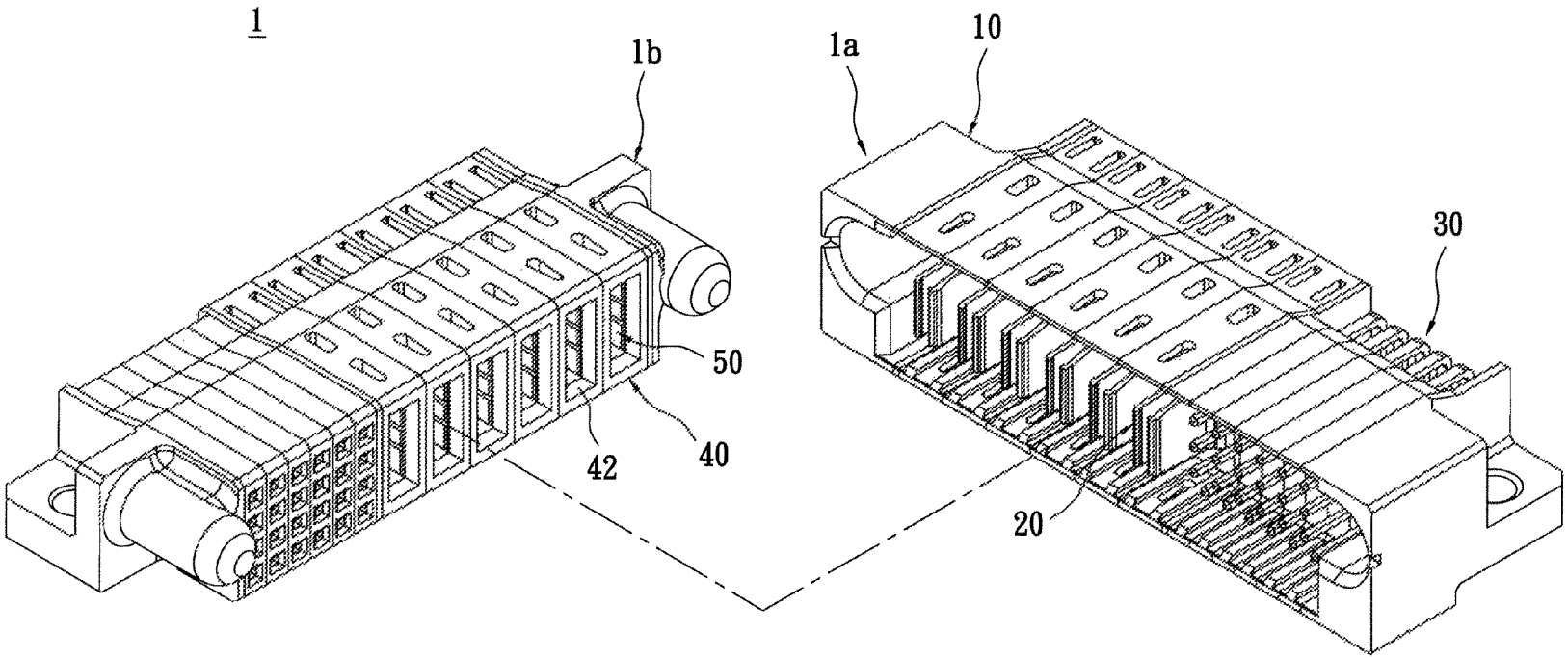
FIG. 1 is a perspective view of a power connector assembly with improved terminals according to the present disclosure.
Figure 2:
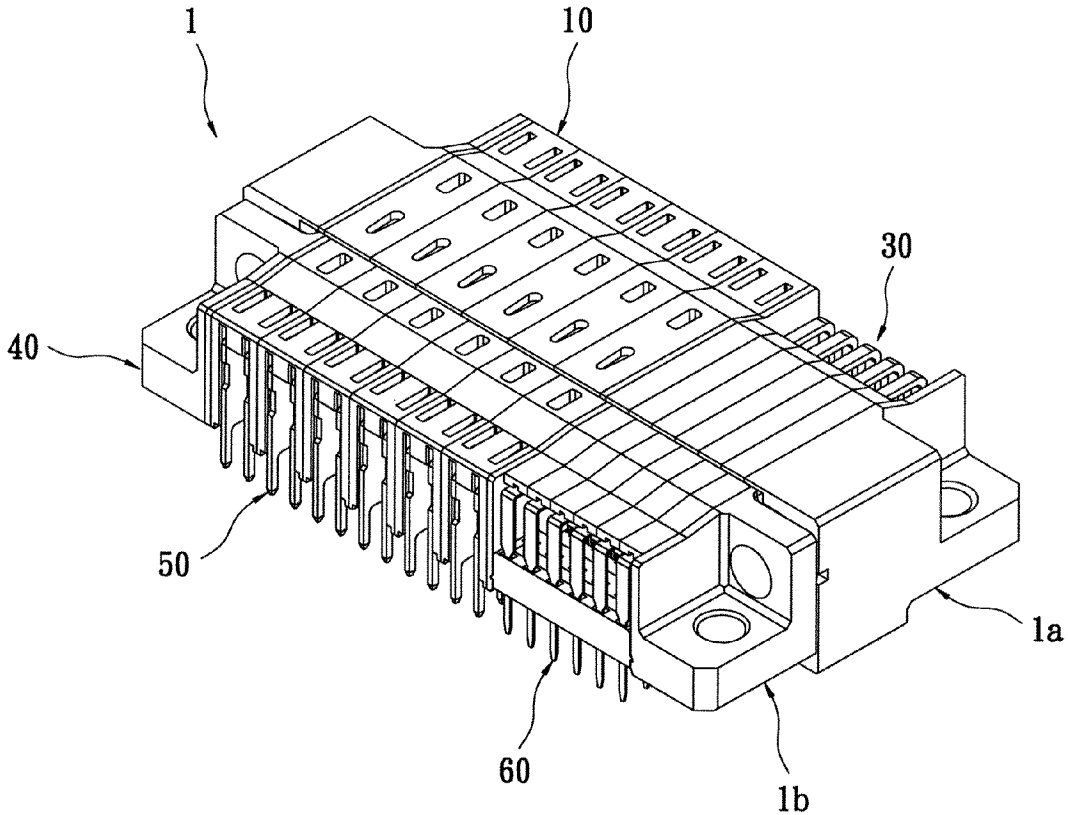
FIG. 2 is an assembled perspective view of the power connector assembly with improved terminals according to the present disclosure.

Reference is made to FIGS. 1 to 2, which are separate perspective view and assembled perspective view of a power connector assembly with improved terminals according to the present disclosure. The present disclosure provides a power connector assembly with improved terminals 1, which includes a first electrical connector 1*a* and a second electrical connector 1*b*. The first electrical connector 1*a* belongs to plug-type electrical connector, and the second electrical connector 1*b* belongs to socket-type electrical connector. Both are soldered fixedly on a circuit board (not shown). As shown in FIG. 2, the first electrical connector 1*a* is plugged in the second electrical connector 1*b* for transmitting power and signals.

Figure 3:
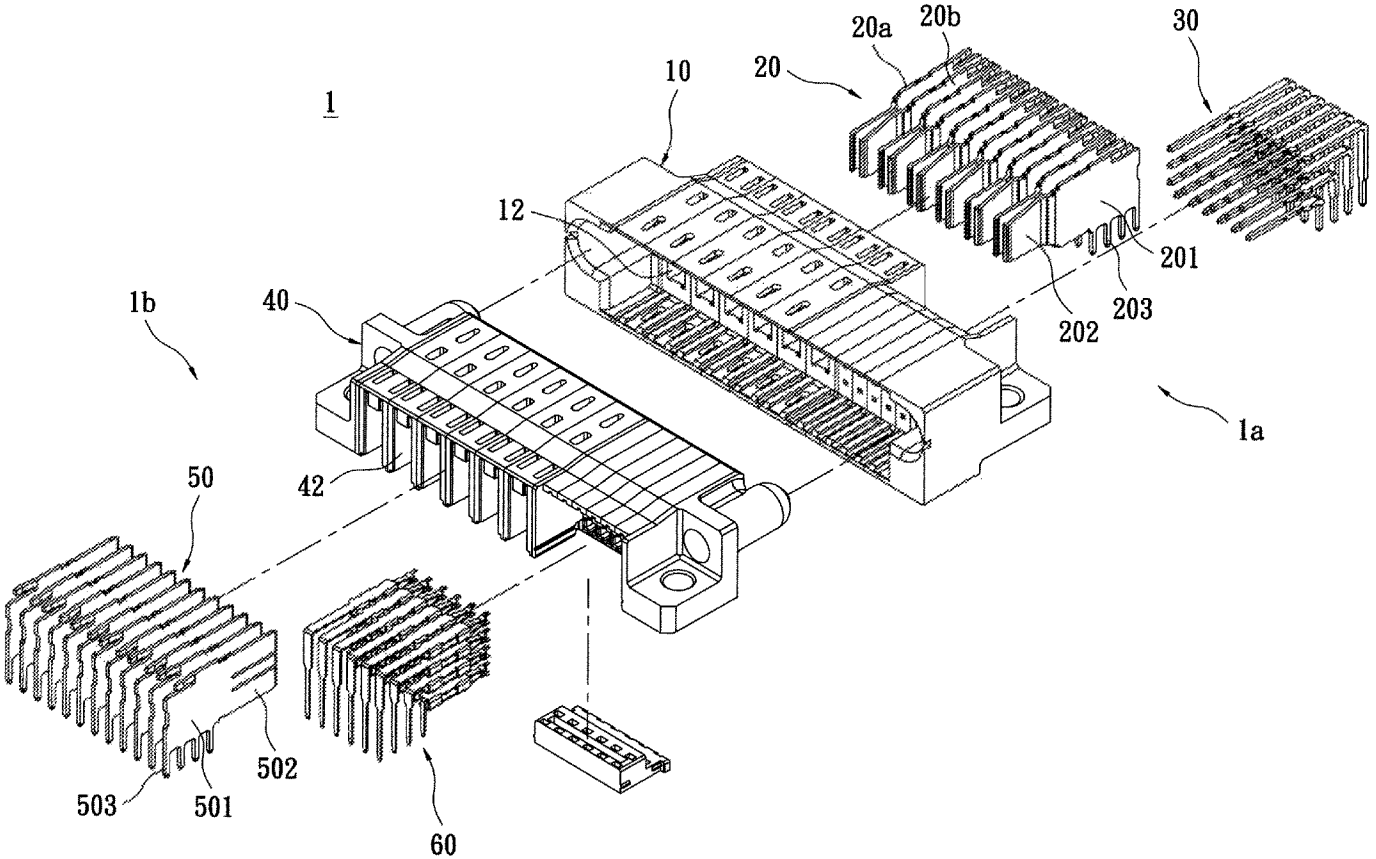
FIG. 3 is an exploded perspective view of the power connector assembly with improved terminals according to the present disclosure.

Please refer to FIG. 3, which shows an exploded perspective view of the power connector assembly with improved terminals according to the present disclosure. The first electrical connector 1*a* has a first insulated body 10, a plurality of first power-terminal sets 20, and a plurality of first signal terminals 30. The first insulated body 10 is formed with a plurality of first terminal receiving grooves 12 for receiving the first power-terminal sets 20 correspondingly.

The second electrical connector 1*b* has a second insulated body 40, a plurality of second power-terminal sets 50, and a plurality of second signal terminals 60. The second insulated body 40 is formed with a plurality of second terminal receiving grooves 42 for receiving the second power-terminal sets 50 correspondingly.

Figure 4:
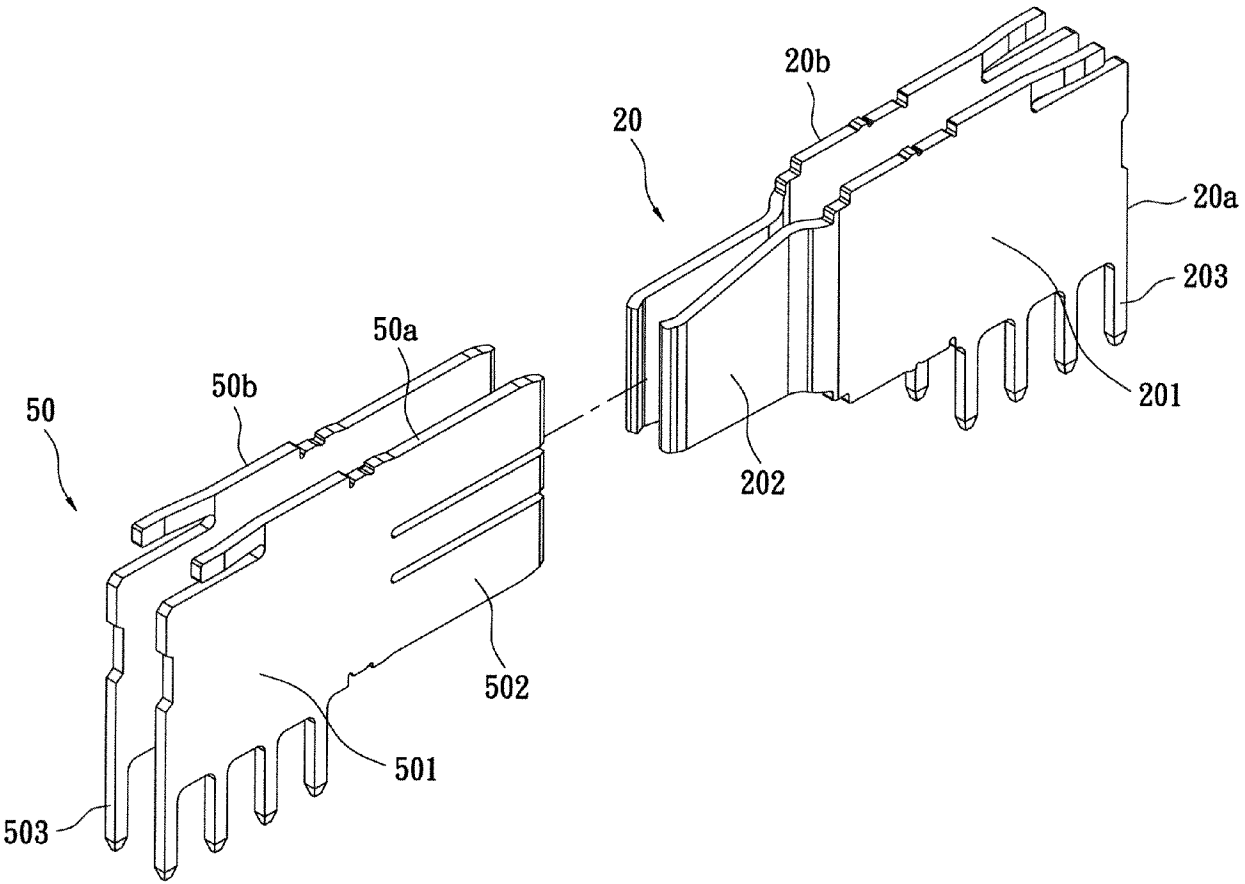
FIG. 4 is a perspective view of first and second power-terminal sets of the present disclosure.

Please refer to FIG. 4, which shows perspective view of first and second power-terminal sets of the present disclosure. The present disclosure improves the characteristic of terminals for enhancing the overall conductivity quality. Each of the first power-terminal sets 20 is corresponded with each of the second power-terminal sets 50. Each first power-terminal set 20 includes two separate first power terminals 20*a* and 20*b*, both are symmetrical to each other. Each second power-terminal set 50 includes two separated second power terminals 50*a* and 50*b*, both are also symmetrical to each other. The first power-terminal set 20 has a front end which is plugged between the corresponding second power terminals 50*a* and 50*b*.

The first power-terminal set 20 may be called "male power-terminal set". The second power-terminal set 50 may be called "female power-terminal set". The power terminals (20*a*, 20*b*; or 50*a*, 50*b*) of the present disclosure are two independent ones and arranged row by row, which has a lower resistance if comparing with the conventional power-terminal set having two power terminals connected to each other. In other word, it is more suitable for high-current applications.

Each of the first power terminals 20*a* and 20*b* has a fixing portion 201, a contacting portion 202 extended forward from the fixing portion 201, and a plurality of soldering legs 203 downwardly extended from a bottom edge of the fixing portion 201. The fixing portion 201 of the first power terminal (20*a* or 20*b*) is wedged in the first terminal receiving groove 12. The soldering legs 203 are evenly distributed on the bottom edge of the fixing portion 201.

Each of the second power terminals 50*a* and 50*b* has a fixing portion 501, a contacting portion 502 forwardly extended from the fixing portion 501, and a plurality of soldering legs 503 extended downward from a bottom edge of the fixing portion 501. The pair of contacting portions 502 of the second power-terminal set 50 contacts with a pair of the contacting portions 202 of the first power-terminal set 20 in a clipping way. The fixing portion 501 of the second power terminal (50*a*, or 50*b*) is wedged in the second terminal receiving groove 42. The plurality of soldering legs 503 are evenly distributed on the bottom edge of the fixing portion 501.

Figure 5:
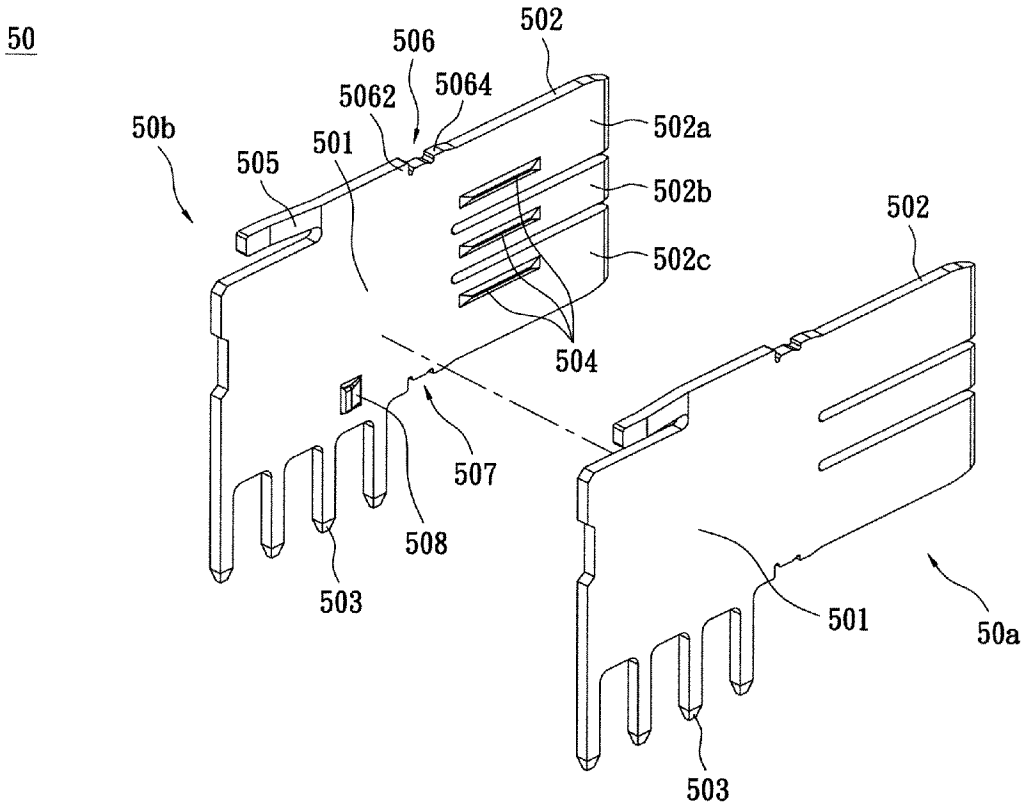
FIG. 5 is a perspective view of the second power-terminal set of the present disclosure.
Figure 6:
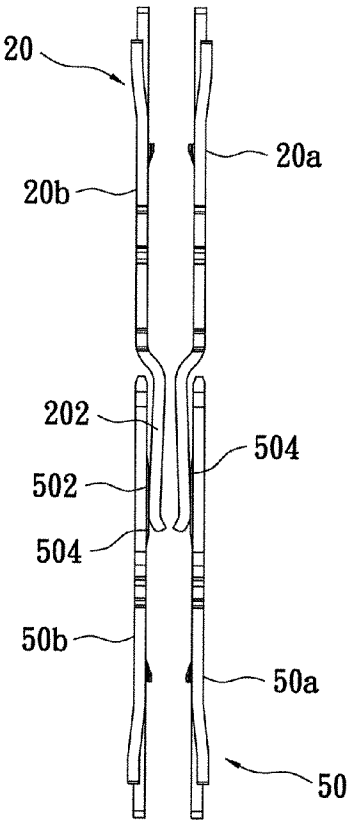
FIG. 6 is a top view of the first power-terminal set contacted with second power-terminal set of the present disclosure.

Please refer to FIGS. 5-6, which show a perspective view of the second power-terminal set and a top view of the first power-terminal set contacted with second power-terminal set of the present disclosure. In this present disclosure, each contacting portion 502 of the second power-terminal set 50 is protruded with at least one bulge portion 504 from a side surface thereof toward the first power-terminal set 20. There is a plurality of bulge portions 504 in this embodiment, which are located on the inner side of the second power terminals 50*a* and 50*b* and could be formed by stamping process. Each of the contacting portions 502 has a plurality of tongue portions 502*a*, 502*b*, and 502*c*. The bulge portions 504 are respectively formed on the tongue portions 502*a*, 502*b*, and 502*c*. In this embodiment, the bulge portion 504 is bar-shaped, which is only illustrated with an emphasis on a protruded structure. Therefore, the bar shape is only to give an example, and it is not limited in this shape. It could be oblate-shaped or a shape of multiple bars.

The present disclosure could increase the contacting stress between the terminals by the bulge portion 504, such that the contact resistance can be reduced and a stable contact can be provided. It thereby could provide high performance current transmission and raise the safety and reliability during operation. Meanwhile, the first insulated body 10 and the second insulated body 40 are designed with a plurality of heat-dissipating ports (not labeled), which are beneficial for dissipating heat from the contacting points of the terminals.

The following introduced is the mounting way of the second power-terminal set 50 of the embodiment. Each of the fixing portions 501 has an elastic-finger portion 505, and a pair of engaging portions 506 and 507 which are respectively formed on a top and bottom edges thereof. The elastic-finger portion 505 is formed at the corner of the top edge of the fixing portion 501 by stamping, and is outwardly and rearwardly extended from the top edge of the fixing portion 501 elastically. The pair of the engaging portions 506 and 507 is near the contacting portion 502. In this embodiment, the engaging portions 506 and 507 are located on the same vertical axis. By this arrangement, the fixing portion 501 of anyone of the second power terminals 50*a* or 50*b* could be fixed securely by four corners on the upper and lower edges, that are the soldering legs 503, the elastic-finger portion 505, and the engaging portions 506 and 507. Therefore, even if the first power-terminal set 20 is inserted into the second power-terminal set 50 with slight misalignment; it will not result in twisting torque and the second power-terminal set 50 will not be loosened or damaged to ensure firm electrical connection. This embodiment thereby makes the second power-terminal set 50 fixed securely in the second insulated body 40 of the electrical connector. The effect of impact of plugging the first power-terminal set 20 to the second power-terminal set 50 will be reduced.

The engaging portions 506 and 507 have the same structure and are securely wedged in the second insulated body 40 in this embodiment. For example, the engaging portion 506 includes a block portion 5062 and a hooked portion 5064 formed in front of the block portion 5062. When the second power terminals 50*a*, 50*b* are inserted into the second insulated body 40 from the back, the hooked portion 5064 would be upwardly engaging with an inner wall of the second terminal receiving groove 42, and then the block portion 5062 would be engaging with a downwardly protruded wall of the second terminal receiving groove 42. In addition, the elastic-finger portion 505 is initially compressed when the second power terminals 50*a*, 50*b* are inserted. When the second power terminals 50*a*, 50*b* are inserted in a fixed position, the elastic-finger portion 505 would expand outward and engage with another wall in the second terminal receiving groove 42. Therefore, the second power terminals 50*a*, 50*b* would not slip backward in providing an anti-loosening design.

Each of the fixing portions 501 further includes a barbed portion 508 inwardly and rearwardly protruded from an inner surface thereof in this embodiment. In other words, the barbed portion 508 extends toward another direction different from that of the elastic-finger portion 505, so that it could be wedged on the another wall of the second terminal receiving groove 42. Both sides of the fixing portion 501 thereby are securely engaged, and it could prevent from moving back to avoid loosening. Therefore, the second power terminals 50*a* and 50*b* are securely fixed in the second terminal receiving groove 42 in the vertical, lateral, and the front and rear direction.

In this embodiment, only the second power-terminal set 50 is illustrated to describe the fixing characteristics. However, as shown in FIGS. 3 and 4, the first power-terminal set 20 of this embodiment also has the same features as the second power-terminal set 50, which are formed at the four corners of the fixing portion 201. In other words, the first power-terminal set 20 is also fixed and received securely in the first terminal receiving groove 12 in the above-mentioned mounting way to reduce the effect of impact when inserting.

The description above only illustrates specific embodiments and examples of the present disclosure. The present disclosure should therefore cover various modifications and variations made to the herein-described structure and operations of the present disclosure, provided they fall within the scope of the present invention as defined in the following appended claims.

What is claimed is:

1. A power connector assembly with improved terminals, comprising:

a first electrical connector, including a first insulated body and a plurality of first power-terminal sets, the first insulated body formed with a plurality of first terminal receiving grooves for respectively receiving the plurality of first power-terminal sets; and a second electrical connector, including a second insulated body and a plurality of second power-terminal sets, the second insulated body formed with a plurality of second terminal receiving grooves for receiving the plurality of second power-terminal sets, wherein each of the first power-terminal sets correspondingly contacts each of the second power-terminal sets, each of the second power-terminal sets has a pair of separate second power terminals, each of the second power terminals having a contacting portion for electrically contacting the first power-terminal set, each of the contacting portions protruded with at least one bulge portion toward the first power-terminal set from a side thereof;

wherein each of the second power terminal includes a fixing portion fixed in the second terminal receiving groove, and a plurality of soldering legs downwardly extending from the fixing portion, wherein the contacting portion forwardly extends from the fixing portion;

wherein each of the fixing portions includes an elastic-finger portion extending outward and rearward from a top edge thereof, and a pair of engaging portions formed on a top edge and a bottom edge thereof, the pair of the engaging portions are adjacent to the contacting portion;

wherein each of the fixing portions further includes a barbed portion protruded inward and rearward from an inner side thereof.

2. The power connector assembly with improved terminals of claim 1, wherein each of the contacting portions is protruded with a plurality of the bulge portions toward the first power-terminal set from a side thereof, each of the contacting portions includes a plurality of tongue portions, each of the tongue portions has one of the bulge portions.

3. The power connector assembly with improved terminals of claim 2, wherein each of the bulge portions is bar-shaped.

4. The power connector assembly with improved terminals of claim 1, wherein the pair of engaging portions are located on the same vertical axis.

5. The power connector assembly with improved terminals of claim 1, wherein each of the engaging portions includes a block portion and a hooked portion located in front of the block portion.

6. The power connector assembly with improved terminals of claim 1, wherein the at least one bulge portions is bar-shaped.

7. The power connector assembly with improved terminals of claim 6, wherein the pair of engaging portions are located on the same vertical axis.

8. The power connector assembly with improved terminals of claim 6, wherein each of the engaging portions includes a block portion and a hooked portion located in front of the block portion.

9. A power connector assembly with improved terminals, comprising:

a first electrical connector, including a first insulated body and a plurality of first power-terminal sets, the first insulated body formed with a plurality of first terminal receiving grooves for respectively receiving the plurality of first power-terminal sets; and a second electrical connector, including a second insulated body and a plurality of second power-terminal sets, the second insulated body formed with a plurality of second terminal receiving grooves for receiving the plurality of second power-terminal sets, wherein each of the first power-terminal sets correspondingly contacts each of the second power-terminal sets, each of the second power-terminal sets has a pair of separate second power terminals, each of the second power terminals having a contacting portion for electrically contacting the first power-terminal set, each of the contacting portions protruded with at least one bulge portion toward the first power-terminal set from a side thereof;

wherein the first power-terminal set includes a pair of separate first power terminals, each of the first and second power terminals includes a fixing portion and a plurality of soldering legs downwardly extended from the fixing portion, wherein the contacting portion is forwardly extended from the fixing portion, each fixing portion has four corners respectively wedged in the first and second terminal receiving grooves;

wherein each of the fixing portions includes an elastic-finger portion extending outward and rearward from a top edge thereof, and a pair of engaging portions respectively formed on a top edge and a bottom edge thereof, the pair of the engaging portions are adjacent to the contacting portion;

wherein each of the fixing portions further includes a barbed portion protruded inward and rearward from an inner side thereof.

10. The power connector assembly with improved terminals of claim 9, wherein the pair of the engaging portions are located on the same vertical axis.

11. The power connector assembly with improved terminals of claim 9, wherein each of the engaging portions further includes a block portion and a hooked portion located in front of the block portion.

* * * * *